US005197662A

United States Patent [19]

Roosa et al.

[11] Patent Number: 5,197,662

[45] Date of Patent: Mar. 30, 1993

[54] PAPERBOARD CARTON FOR FROZEN FOODSTUFFS

[75] Inventors: Paul D. Roosa, Sangerties; Robert L. Gordon, Monroe, both of N.Y.

[73] Assignee: International Paper Company, Purchase, N.Y.

[21] Appl. No.: 851,703

[22] Filed: Mar. 16, 1992

[51] Int. Cl.[5] ..... B65D 5/54

[52] U.S. Cl. ..... 229/244; 229/160.2; 229/243

[58] Field of Search ..... 229/206, 221, 223, 235, 229/243, 244, 160.2

[56] References Cited

U.S. PATENT DOCUMENTS

| | | | |
|---|---|---|---|
| 1,649,452 | 11/1927 | DeClercq | 229/244 |
| 1,940,849 | 12/1933 | Davidson | 229/223 |
| 1,973,237 | 9/1934 | Vilas . | |
| 2,007,520 | 7/1935 | Daller | 229/223 |
| 2,122,885 | 7/1938 | Lowey . | |
| 2,249,244 | 7/1941 | Guyer | 229/223 |
| 2,299,461 | 10/1942 | Clanon . | |
| 2,347,161 | 4/1944 | Watts et al. . | |
| 2,596,087 | 5/1952 | Shoudy . | |
| 2,750,101 | 6/1956 | Jacke . | |
| 3,097,785 | 7/1963 | Meyers | 229/223 |
| 3,125,276 | 3/1964 | Zinn . | |
| 3,141,597 | 7/1964 | Palmer . | |
| 3,204,849 | 9/1965 | Vinney . | |
| 3,217,966 | 11/1965 | Kelly . | |
| 3,295,739 | 1/1967 | Wilcox . | |
| 3,349,959 | 10/1967 | Watkins . | |
| 3,593,911 | 7/1971 | Pellaton . | |
| 3,620,439 | 11/1971 | Morse et al. . | |
| 3,773,248 | 11/1973 | Cecil et al. . | |
| 3,826,421 | 7/1974 | Morse et al. . | |
| 3,951,333 | 4/1976 | Forbes, Jr. et al. . | |
| 4,332,577 | 6/1982 | Mosse . | |
| 4,397,415 | 8/1983 | Lislecki | 229/223 |
| 4,422,570 | 12/1983 | Lisiecki . | |
| 4,582,246 | 4/1986 | Lisiecki . | |
| 4,634,008 | 1/1987 | Strole et al. . | |
| 4,740,163 | 4/1988 | Kuchenbecker . | |
| 4,796,760 | 1/1989 | Rausing . | |
| 4,865,203 | 9/1989 | Ueda . | |
| 4,911,305 | 3/1990 | Chung et al. . | |
| 4,911,306 | 3/1990 | Lisiecki et al. . | |
| 4,979,621 | 12/1990 | Chung . | |

*Primary Examiner*—Gary E. Elkins
*Attorney, Agent, or Firm*—Michael J. Doyle

[57] ABSTRACT

A carbon formed from a unitary blank of paperboard and being of rectangular parallelepiped shape. The carton is particularly adapted to contain a food product, such as a frozen juice concentrate or a frozen mass of other food product. The invention relates to a top closure construction which enables the consumer to remove the top closure so that the carton contents, particularly if in the form at a frozen brick, can easily be removed. Further, after such removal, the remainder of the carton can function as a measuring container for pouring any liquids therein which are to be added to the food product. These functions are achieved by the provision frangible lines, such as perforated tear lines, straight across the carton sidewalls, contiguous to the top of the carton sidewalls. The carton top closure is provided with a pull tab or a fin having a free end which can be manually grasped by the consumer. Upon pulling the pull tab or fin, the perforated lines are ruptured and the container top closure can be displaced from the remainder of the container and thus permit sliding removal of the frozen food product. The interior surface of the carton is provided with a frangible barrier layer, such as a conventional polyethylene or other extruded layer, to cover the perforations of the perforated lines and thus prevent leakage and also contamination of the carton contents through the perforations.

9 Claims, 5 Drawing Sheets

10
11
11a
12
14
16
18
20
24
26
27
29
30
31
33
34
35
36
37
38
40
42
44
46
47
50
54
2.

FIG. 3
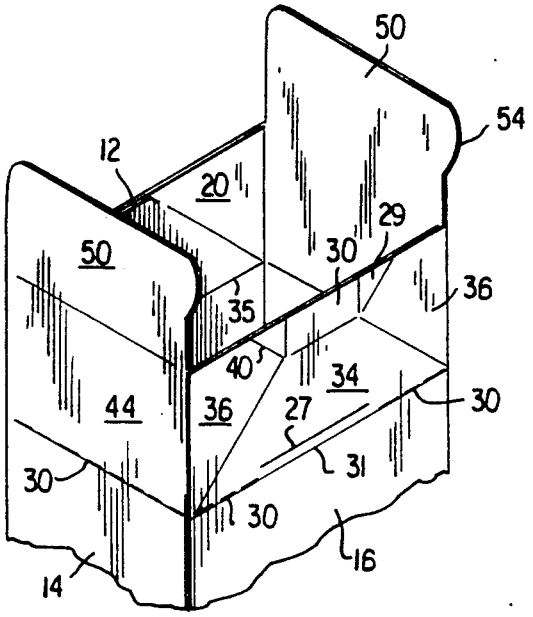
FIG. 4
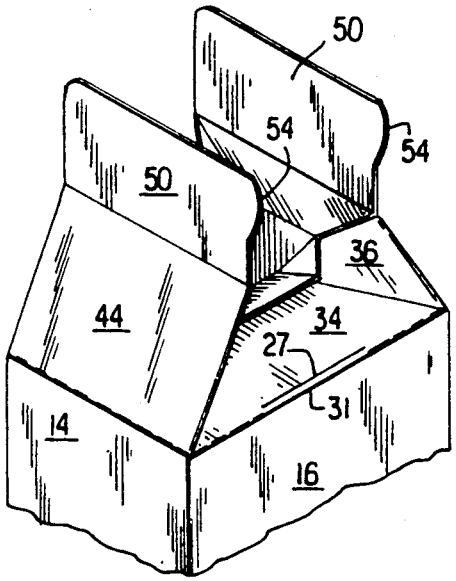
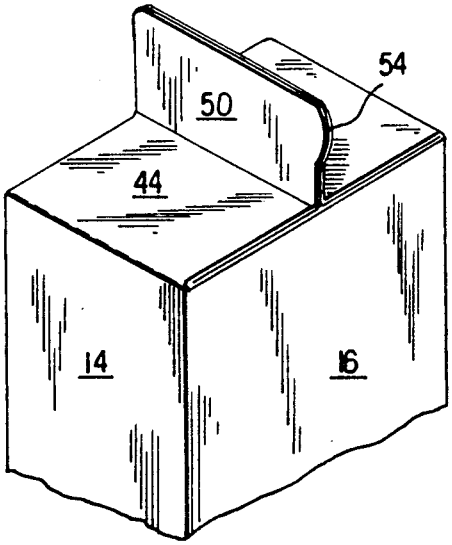
FIG. 5
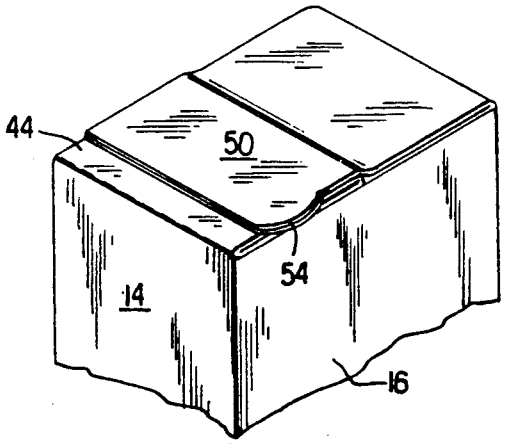
FIG. 6

FIG. 10
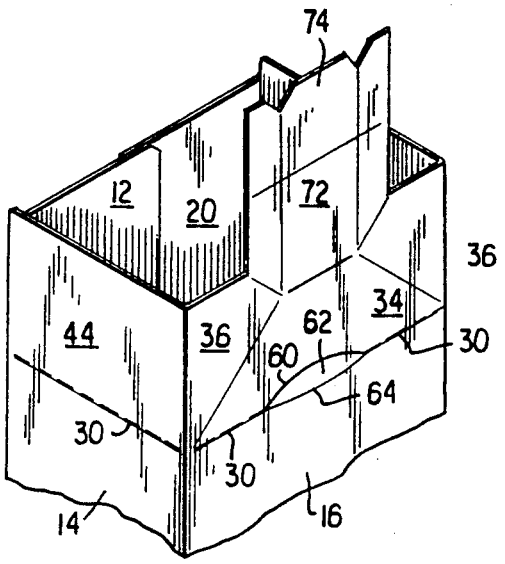
FIG. 11
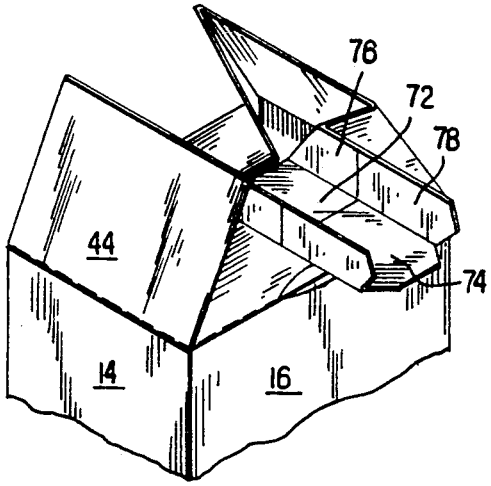
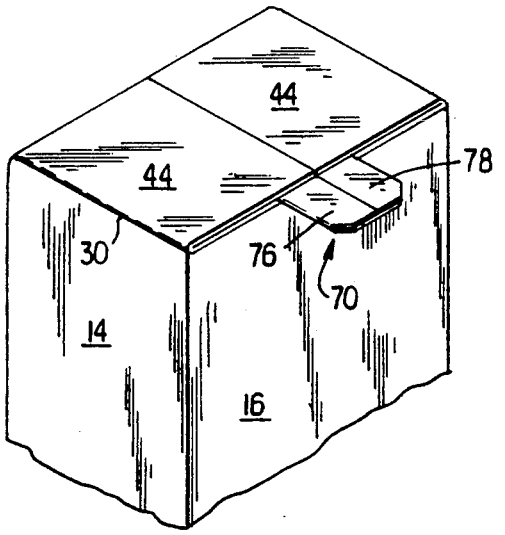
FIG. 12
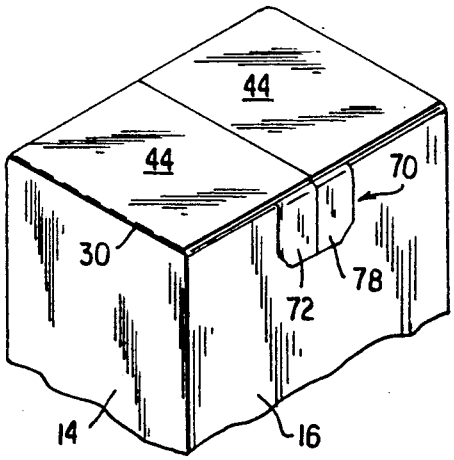
FIG. 13

PAPERBOARD CARTON FOR FROZEN FOODSTUFFS

BACKGROUND OF THE INVENTION

This invention relates to containers and more particularly to containers fashioned from a unitary blank of paperboard or other stiff, resilient, and foldable sheet material. The container is in the form of a rectangular parallelepiped, sometimes termed a brick pack. The container exhibits particular utility for the packaging of food products such as highly viscous, concentrated fruit juices or frozen juice concentrates.

U.S. Pat. Nos. 4,754,917 issued to Gordon et al and 4,785,993 issued to Lisiecki disclose rectangular parallelepiped shaped containers having a flat end closures wherein no raw edges of the paperboard at an end closure are exposed to the carton contents. At least the inner surface, and usually also the outer surface, of such containers are coated with a barrier layer, usually polyethylene, which has been extruded onto the surfaces of the blanks from which the cartons are formed. The contents of these cartons are dispensed through a pour opening in one of the end closure panels.

While satisfactory for the purposes intended, these constructions suffer the drawback that the container contents, if frozen, are difficult to remove. The user must either thaw the package to permit pouring of the contents from a pour opening in the carton, or resort to attempting to saw or manually rip the container to obtain the frozen brick.

SUMMARY OF THE INVENTION

According to the practice of this invention, this drawback of known paperboard carton or containers is overcome by a fin and perforated (frangible) line arrangement. One or more of the end closure panels of the carton is provided with a pull tab, preferably integral with the blank from which the carton is formed, with the fin having a free end which extends to the carton exterior so as to be manually grasped. At least three perforated lines are provided on respective side walls of the carton, preferably contiguous to the end closure, with each line spanning the width of a respective sidewall. The perforations or cuts of the lines are covered over with barrier layer material, such as polyethylene, on the carton interior to prevent leakage and in most cases also on the outer carton surface where moisture and condensation may occur. In operation, the user grasps the carton with one hand and, with the other hand, pulls the fins. This causes the perforated (frangible) lines to tear, thereby permitting the end closure to fold open about the single, unperforated sidewall and permit the brick of frozen concentrate to slide out of the carton. Alternatively, all four of the sidewalls may be perforated. In this latter case, the pulling of the fins results in complete separation of the end closure from the carton, again permitting the frozen brick of juice concentrate to slide out of the carton. After the frozen brick has been removed, the carton may be used as a measuring container.

BRIEF DESCRIPTION OF THE DRAWINGS

FIGS. 3 to 6 are partial perspective views showing the folding sequence of the upper portion of the blank of FIG. 1 to form an end closure.

FIGS. 10 to 13 are partial perspective views showing the folding sequence of the upper portion of the blank of FIG. 9 to form an end closure.

DETAILED DESCRIPTION OF THE INVENTION

Figures 1, 2:
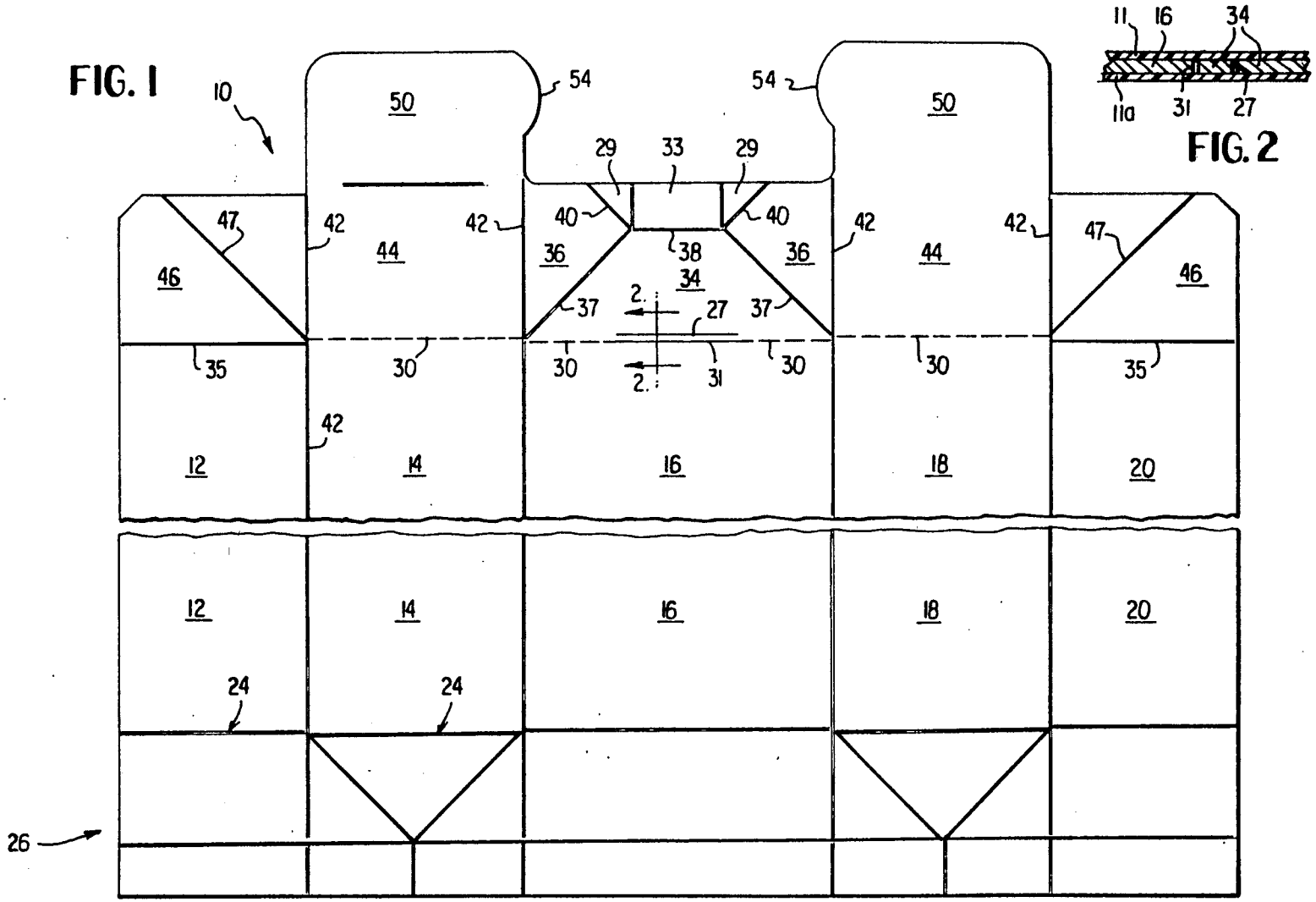
FIG. 1 is a plan view of a unitary blank of paperboard from which the carton of this invention is fashioned.
FIG. 2 is a view taken along section 2—2 of FIG. 1.

Referring now to FIGS. 1 and 2 of the drawings, the numeral 10 denotes generally a unitary blank 8 of paperboard or other stiff, resilient, and foldable sheet material provided with perforated lines and fold lines. Spaced perforations in the form of cuts through the paperboard define the particular frangible lines illustrated, but any other type of paper treatment may be employed. The blank includes a plurality of generally rectangular sidewall forming panels, 12, 14, 16, 18, and 20. The blank surface facing the reader is coated with a barrier layer material, such as polyethylene. This surface will be the interior surface of the carton formed from the blank.

Any desired configuration of bottom end closure panels, which communicate with sidewall forming panels 12–20 by means of fold lines 24, are denoted as 26. The exact form of the bottom end closure panels 26 is not material for the practice of this invention.

An upper series of perforated lines 30 is provided at the top of the sidewall forming panels 14, 16, and 18 at their respective junctions with the lower portions of top end closure panels 34 and 44. Fold lines 35 at the top of sidewall panels 12 and 20, join the latter to top end closure panels 46. Upper end closure panel 34 includes areas 36 defined by fold lines 37, 38, and 40. Fin panels 50 are defined by fold lines to the upper portions of panels 44. Each top end closure panel 46 is provided with a slanted fold line 47. Panels 44 are termed outermost top closure panels, while panels 34 and 46 are termed innermost closure panels.

Each of fins 50 is provided with at least one laterally extending finger tab or ear 54.

The fold lines on panel 34, defining the indicated sub-areas therein, are of a known construction, except for cut line 27. Parallel cut lines 27 and 31 extend through the paperboard. Cut line 31 is coaxial with its neighboring perforated lines 30. Fold lines 35 and cut lines 30 are slightly vertically staggered, as indicated.

Referring now to FIG. 2 of the drawings, the cross section shows cut lines 27 and 31 extending through the paperboard and covered by interior barrier layer 11 and (optional) external barrier layer 11*a*.

Except for the presence of perforated lines 30, cut lines 27 and 31 and fins 50, the blank of FIG. 1 is generally known in this art, as may be seen, for example, from U.S. Pat. No. 4,785,993 issued to Lisiecki, above noted. It will be understood that perforated lines 30 may be substituted for the fold lines 35 of sidewall panels 12 and 20.

Referring now to FIGS. 3–6 of the drawings, the sequence of folding operations to form the carton from the blank is illustrated. In general, the manner of folding is the same as that shown in the noted Lisiecki patent.

As shown at FIG. 6, at the completion of the folding of the top closure of the carton, fins 50 are in surface contact with each other and are folded down on outermost top flap 44 and are sealed, as by heat sealing. The fins may be folded down in either of two directions. The central longitudinal axis of the carton is denoted as 56 at FIG. 6.

In operation, the container having therein a frozen juice concentrate or the like is opened by grasping it with one hand and pulling on finger tabs 54 of fins 50 to thereby raise the fins from their flat, folded position to a substantially vertical position. Now, the (double thickness) fins are grasped between the thumb and forefinger, while still grasping the container with the other hand, and fins 50 are pulled up and away from cut lines 27 and 31, i.e., pulled upwardly. This pulling results in a rupture of perforated lines 30, enabling the top end closure to pivot or swing away from the top of the carton, about fold lines 35, thus allowing the frozen brick of frozen juice concentrate or the like to slide out of the carton. Cut lines 27 and 31 assist in commencing the rupture of the perforated lines. If sidewalls 12 and 20 are provided with perforated lines 30, instead of fold lines 35, then pulling of fins 50 results in a complete removal of the top end closure from the container. By maintaining the top end closure joined to the container, however, disposal of all portions of the used container is facilitated. The opened carton may now be employed as a measuring cup or container in which to place water which may be added to the frozen brick.

Perforated lines 30 may also assume the form of reverse cuts or microcuts, the latter two types of frangible or tearable lines being well known in this art. Any one of these or other frangible connections may be employed.

The end closure has been illustrated and described as a top end closure. Clearly, it could be a bottom end closure as well. Further, in the embodiment described above as well as those to follow, geometrical terms of orientation such as upper, lower, and the like are employed to assist the reader to an understanding and are not intended as terms of limitation.

Figure 7:
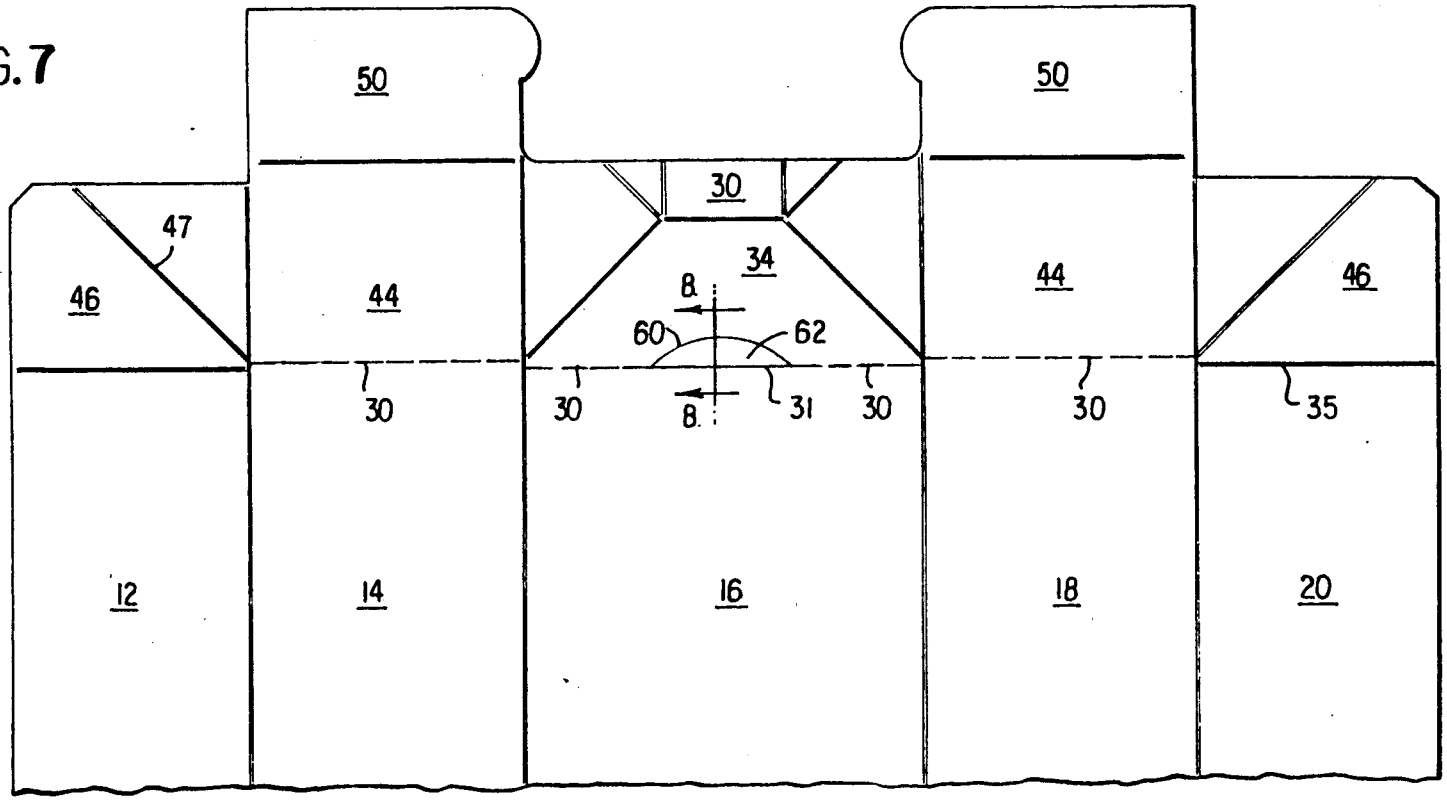
FIG. 7 is a view similar to FIG. 1 and illustrates the upper portion of a similar blank showing a second embodiment.

Referring now to FIG. 7 of the drawings, the upper portion of another unitary paperboard blank is illustrated, the blank being similar to that of FIG. 1 except for the absence, in the blank of FIG. 7, of cut lines 27 and 31, and in the presence of a sector shaped cut-out. In the blank of FIG. 7, the same numerals have been employed to denote corresponding elements. An arcuate cut 60 intersects with cut 31 to define a part circular sector 62. Sector 62 is spanned by both the inner and outer barrier layers of the blank. In the case where no outer barrier layer is employed, 62 is spanned only by the inner barrier layer. As with the blank of FIG. 1, that surface of the blank portion shown at FIG. 7 which faces the reader is to be the interior surface of the carton.

Figure 8:
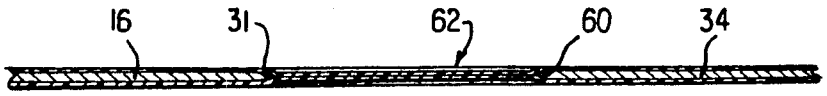
FIG. 8 is a view taken along sections 8—8 of FIG. 7.

FIG. 8 illustrates the covering of sector 62 by the barrier layers. The barrier layers are more easily rupturable than the paperboard from which the blank is formed.

A carton and end closure therefor is formed from the blank of FIG. 7 in the same manner as that illustrated at FIGS. 3-6 with the blank of FIG. 1. Namely, the right and left ends of the blank of FIG. 7 are glued together to form a rectangular tube, then the blank is folded to form a flat topped end closure as indicated at FIGS. 3 to 6. The mode of operation, i.e., opening the end closure, is the same as that previously described, except that sector 62 may be used to facilitate or augment ripping or tearing of the frangible connections, as by inserting a fingernail or other hard edge into the sector and pushing upwardly.

Figure 9:
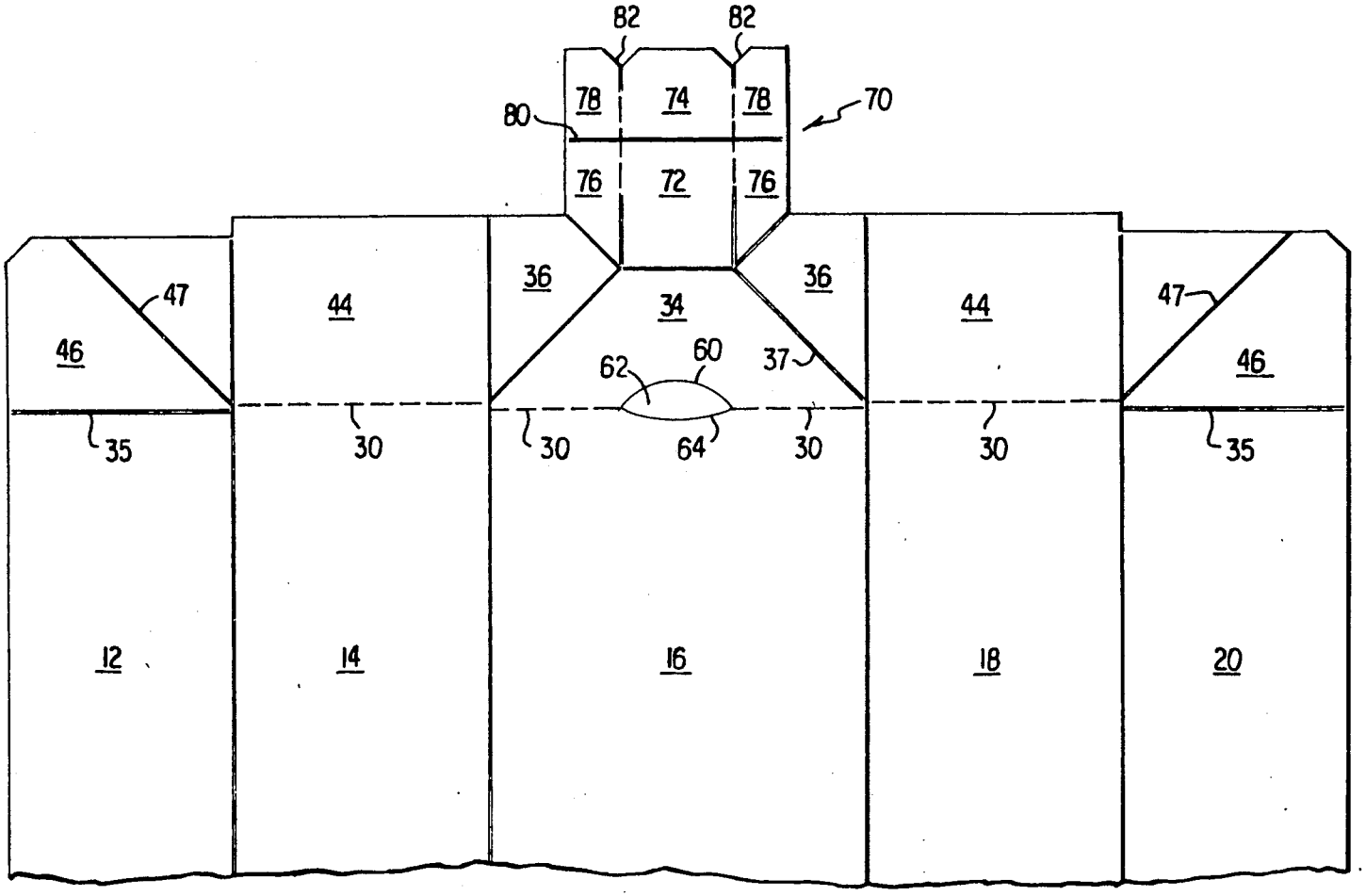
FIG. 9 is a view similar to FIG. 1 and illustrates the upper portion of a similar blank, showing a third embodiment.

Referring now to FIG. 9 of the drawings, another blank is illustrated and shows yet a third embodiment of the invention. The blank of FIG. 9 is generally similar to the previous blanks described, with corresponding reference numerals denoting corresponding elements. Again, a part circular cut 60 is made at the bottom central portion of top closure panel 34, with the upper central portion of side wall panel 16 having another part circular cut 64. Cuts 60 and 64 define a sector, again designated at 62. Sector 62 is spanned on at least the inside surface of the blank by a barrier layer material as with the other embodiments previously described.

The upper portion of top closure panel 34 is provided with a pull tab 70 foldably and integrally connected to panel 34. Pull tab 70 includes central regions 72 and 74, and identical lateral regions or subpanels 76 and 78. These panels are separated by fold line 80, with the top of pull tab 70 provided with V-notches 82.

FIGS. 10 through 13 show the method of formation of an upper end closure with the blank of FIG. 9. Again, the blank is secured together its left and right edges and folded along the several scone/fold lines of the blank to form a rectangular tube, in the manner indicated at FIG. 10. Then, the inner and outer top closure panels are folded, as shown at FIG. 11, with pull tab 70 folded in the manner shown. Continued folding of the top closure panels result in the configuration of FIG. 12, wherein the outermost and innermost top closure panels have been completely folded, with the free end of pull tab 70 extending laterally. In the last step, pull tab 70 is folded down against front side wall 16 of the carton and fastened into place as by the application of heat. Pull tab 70, as well as fins 50, may each be termed pull panels.

To open the container, pull tab 70 is grasped and pulled upwardly, to thereby rip the frangible or perforated lines and thus remove the top closure of the carton for dispensing of its frozen contents. Again, the barrier layers spanning sector 62 may be broken by a fingernail of the consumer, with the fingernail then pushing up, to augment rupture of the frangible lines and thus swing the top closure away for dispensing of a frozen brick within the container.

We claim:

1. A carton in the shape of a rectangular parallelepiped having a central longitudinal axis, the carton formed from a unitary paperboard blank and having an interior surface, the carton having a top end closure and four substantially rectangular sidewalls, each sidewall having an uppermost edge foldably joined to said top end closure, at least three of said sidewalls provided with a respective frangible line across their respective widths, said frangible lines each located contiguous to an end of a said respective sidewall panel, a frangible barrier layer coating the interior surface of said carton, said coating covering the carton interior surface portions of said three frangible lines, means carried by the carton to facilitate manual rupture of said frangible lines by pulling the top end closure away from the remainder of the carton to permit said top end closure to be displaced from the remainder of the carton, so that any carton contents can be emptied without interference from said top closure, said means including at least one fin carried by the top closure and extending beyond one of said sidewalls of the carton to permit manual grasping of the fin, and wherein said means includes a cutout extending completely through said paperboard blank but not through said barrier layer and bordering on at least one of said frangible tear lines, said frangible barrier layer on the interior surface covering said cutout, whereby a fingernail or other edge can be inserted into said cutout to rupture said barrier layer covering said cutout sand assist in displacing said top closure.

2. The carton of claim 1 wherein said cutout interrupts one of said perforated tear lines.

3. The carton of claim 1 wherein each sidewall has an uppermost edge foldably joined to a respective top closure panel, two opposite of said top closure panels being outermost top closure panels, the other two opposite of said top closure panels being innermost top closure panels, said two outermost top closure panels lying in a common plane at right angles to said longitudinal axis, each of said top closure panels foldably joined to a said next adjacent top closure panel, said innermost and said outermost top closure panels defining said top end closure, at least one of said outermost top closure panels carrying a fin panel, said fin panel folded down on one of said outermost top closure panels.

4. The carton of claim 3 wherein said fin is integral with said at least one of said top end closure panels.

5. The carton of claim 3 wherein said at least one fin carries a finger tab, said finger tab extending beyond a plane containing of one of said four sidewall panels.

6. A carton in the shape of a rectangular parallelepiped having a central longitudinal axis, the carton formed from a unitary paperboard blank, the carton having a top end closure and four substantially rectangular sidewalls, each sidewall having an uppermost edge foldably joined to said top and closure, at least three of said sidewalls provided with a respective frangible line across its respective width to thus define three sets of frangible lines, said frangible lines each located contiguous to the upper end of a respective sidewall panel, a frangible barrier layer coating the interior surface of said carton, said coating covering the interior portions of said three frangible lines, means carrier by the carton to facilitate manual rupture of said frangible lines by pulling the top end closure away from the remainder of the carton to permit said top end closure to be displaced from the remainder of the carton, so that the carton contents can be emptied without interference from said top closure, wherein each sidewall has an uppermost edge foldably joined to a respective top closure panel, two opposite of said top closure panels being outermost top closure panels, the other two opposite of said top closure panels being innermost top closure panels, said two outermost top closure panels lying in a common plane at right angles to said longitudinal axis, each of said top closure panels foldably joined to a next adjacent top closure panel, said innermost and said outermost top closure panels defining said top end closure, a pull tab, said pull tab having a free end and being an extension of one of said innermost top end closure panels, said pull tab free and extending down from said top end closure and along one of said sidewalls.

7. The carton of claim 6 wherein a portion of said pull tab passes between one of said innermost top end closure panels from which it extends and said outermost top end closure panels.

8. A unitary blank of paperboard having two surfaces and coated over at least one of its surfaces with a barrier layer, said blank including five generally rectangular sidewall and end forming panels joined in side by side serial relation, at least three of said sidewall panels each having a frangible line spanning said panel, each frangible line located near one end of a said respective sidewall panel, two of said end forming panels each carrying a pull panel at an end of a respective end forming panel portion thereof, each said pull panel located above a sidewall forming panel which has a said frangible line, said pull panels being of substantially the same shape and size and being spaced from each other by one of said sidewall forming panels.

9. The blank of claim 8 including a cutout extending completely through said paperboard blank and bordering on at least one of said frangible lines.

* * * * *